US011353175B1

(12) United States Patent
Xie et al.

(10) Patent No.: US 11,353,175 B1
(45) Date of Patent: Jun. 7, 2022

(54) LED LIGHT, SMART LIGHT STRINGS, SMART CURTAIN LIGHT STRINGS, AND SMART NET LIGHT STRINGS

(71) Applicant: SHENZHEN EKOLA LIGHTING TECHNOLOGY CO., LTD., Shenzhen (CN)

(72) Inventors: Dingbo Xie, Shenzhen (CN); Jianbo Chen, Shenzhen (CN); Bingbin Jia, Shenzhen (CN); Jie Liu, Shenzhen (CN)

(73) Assignee: SHENZHEN EKOLA LIGHTING TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/340,066

(22) Filed: Jun. 6, 2021

Related U.S. Application Data

(63) Continuation of application No. PCT/CN2021/087882, filed on Apr. 16, 2021.

(51) Int. Cl.

| | |
|---|---|
| ***F21S 4/10*** | (2016.01) |
| ***F21V 23/00*** | (2015.01) |
| ***F21V 23/02*** | (2006.01) |
| ***F21V 17/10*** | (2006.01) |
| ***F21V 23/06*** | (2006.01) |
| ***F21V 3/02*** | (2006.01) |
| ***F21Y 115/10*** | (2016.01) |

(52) U.S. Cl.
CPC ..... *F21S 4/10* (2016.01); *F21V 3/02* (2013.01); *F21V 17/101* (2013.01); *F21V 23/002* (2013.01); *F21V 23/003* (2013.01); *F21V 23/02* (2013.01); *F21V 23/06* (2013.01); *F21Y 2115/10* (2016.08)

(58) Field of Classification Search
CPC .. F21S 4/10; F21V 3/02; F21V 17/101; F21V 23/002; F21V 23/003; F21V 23/02; F21V 23/06
USPC ..... 362/237
See application file for complete search history.

(56) References Cited

U.S. PATENT DOCUMENTS

| | | | | |
|---|---|---|---|---|
| 2004/0233668 | A1* | 11/2004 | Telfer | F21S 4/10 362/249.16 |
| 2008/0025025 | A1* | 1/2008 | Tong | F21S 4/10 362/249.16 |
| 2010/0134025 | A1* | 6/2010 | Link | H05B 47/155 315/185 R |
| 2010/0135024 | A1* | 6/2010 | Gier | F21V 3/02 362/294 |

(Continued)

*Primary Examiner* — Bryon T Gyllstrom

(57) ABSTRACT

The present disclosure provides an LED light, smart light strings, smart curtain light strings, and smart net light strings. The LED light (1) includes the conductive structure (100) connected with the power supply, the plurality of the LED light beads (200), and the plurality of transparent light shells (300) having transparent features. The plurality of the LED light beads (200) are electrically connected with the conductive structure (100) and disposed at intervals along the length direction of the conductive structure (100), however, each of the transparent light shells (300) is corresponding to the respective LED light bead (200) and wraps the respective LED light bead (200). Each of the transparent light shells (300) includes the through holes (301) for the conductive structure (100) to penetrate through.

12 Claims, 9 Drawing Sheets

(56) References Cited

U.S. PATENT DOCUMENTS

| | | | | |
|---|---|---|---|---|
| 2015/0084515 | A1* | 3/2015 | Altamura | H05B 47/115<br>315/131 |
| 2021/0071828 | A1* | 3/2021 | Shan | F21S 4/10 |
| 2021/0071850 | A1* | 3/2021 | Shan | F21S 4/20 |
| 2021/0071852 | A1* | 3/2021 | Shan | F21V 23/002 |

* cited by examiner

LED LIGHT, SMART LIGHT STRINGS, SMART CURTAIN LIGHT STRINGS, AND SMART NET LIGHT STRINGS

TECHNICAL FIELD

The present disclosure relates to a technical field of lighting decoration, in particular to an LED light, smart light strings, smart curtain light strings, and smart net light strings.

BACKGROUND

As a novel light source, LED is gaining more and more attention. In some lighting decoration occasions, LED light strings are usually used. A conventional LED light string mainly uses two pins to connect conventional LED light beads with a corresponding wire to form the string. However, the two pins of the conventional LED light string are hard materials and directly exposed, and the conventional LED light string is usually wrapped or sealed by waterproof glue tape, subject to environmental factors, which serve life is relatively short, waterproof performance is poor, has a leakage risk, and brings potential safety hazards.

SUMMARY

An object of the present disclosure is to provide an LED light, smart light strings, smart curtain light strings, and smart net light strings to solve a technical problem that a wire connecting part of a conventional LED light string is usually wrapped or sealed by waterproof glue tape, subject to environmental factors, which serve life is relatively short, waterproof performance is poor, has a leakage risk, and brings potential safety hazards.

In order to achieve the above object, the present disclosure provides an LED light. The LED light includes a conductive structure connected with a power supply and a plurality of LED light beads. The plurality of the LED light beads are electrically connected with the conductive structure and disposed at intervals along a length direction of the conductive structure. The LED light further includes a plurality of transparent light shells, each of the transparent light shells wraps a respective LED light bead. The conductive structure penetrates through through holes of each of the transparent light shells to extend to outside, and each of the transparent light shells seals the respective LED light bead and a respective wire connecting position inside.

Optional, each of the transparent light shells includes a respective accommodation cavity, the respective LED light bead is disposed inside the respective accommodation cavity, and a gap is reserved between a cavity wall of the respective accommodation cavity and the respective light bead of each of the transparent light shells.

Optional, a respective glue injection hole is formed on each of the transparent light shells. A transparent liquid glue is injected into each of the transparent light shells from the respective glue injection hole, the transparent liquid glue is filled with the respective accommodation cavity of each of the transparent light shells, and the transparent liquid glue is subjected to normal temperature standing or heating for curing to form a solid sealing body.

Optional, the respective glue injection hole on each of the transparent light shells is disposed opposite to the respective LED light bead.

Optional, an inner wall of the respective accommodation cavity of each of the transparent light shells is subjected to sanding treatment or sand blasting treatment, so that an uneven diffuse reflection surface is formed on a surface of the inner wall of the respective accommodation cavity.

Optional, each of the transparent light shells includes two half-shells, the two half-shells are fastened together and jointly wrap the respective LED light bead.

The present disclosure further provides smart light strings, including a driving unit and the LED light. The driving unit includes a driving board and a driving shell. The driving board is fixed in the driving shell, a connection port is disposed on the driving shell, and an end of the LED light penetrates through the connection port and is connected to the driving board.

Furthermore, the driving shell includes a bottom shell having a shell accommodation cavity and a cover board detachably connected with the bottom shell. The driving board is fixed to the shell accommodation cavity, and the connection port is disposed on the bottom shell.

Furthermore, the driving unit includes a connection clamping block. A fixing connection hole, communicated up and down, is disposed on the connection clamping block. An end of the conductive structure penetrates through the fixing connection hole and is tightly connected to the fixing connection hole. And the connection clamping block is inserted in the connection port of the bottom shell.

The present disclosure further provides smart curtain light strings, including a top shell, a driving unit, and a plurality of the LED lights. The driving unit is fixed to the top shell and electrically connected with an external power source. A plurality of butt-joint holes disposed at intervals are formed on a bottom of the top shell. An end of each of the plurality of the LED lights is driven and connected with the driving unit through a respective butt-joint hole. Each of the plurality of the LED lights is vertically disposed below the top shell.

Optional, the smart curtain light strings further include a plurality of wiring structures. Each of the wiring structures includes a respective first connection piece and a respective second connection piece. The respective first connection piece is fixedly connected with an end of a respective LED light, the respective second connection piece is fixed to the respective butt-joint hole and is connected with the driving unit. The respective first connection piece is detachably connected with the respective second connection piece, so that the plurality of the LED lights establish a driving connection with the driving unit.

Furthermore, the smart curtain light strings include at least two fixing structures. Each of the fixing structures includes a groove-shaped piece having a U-shaped groove, pins protruding from two inner side walls of the U-shaped groove, and a fixing board extending from a back surface of the groove-shaped piece in a direction distal from the U-shaped groove. Clamping grooves are formed at two sides of a top in the top shell, and each of the clamping pins is inserted into a respective clamping groove.

Specifically, the groove-shaped piece includes a first side plate, a second side plate, a connection plate, and a movable plate. The first side plate and the second side plate are respectively connected to opposite sides of the connection plate and jointly form the U-shaped groove with the connection plate. The first side plate is higher than the second side plate. A respective pin is disposed on a plate surface, facing the second side plate, of the first side plate. An another pin is disposed on a plate surface of the movable plate. The movable plate is detachably connected with the second side plate, and the respective pin is opposite to the another perspective pin.

Optional, the top shell includes a side cover plate and a main shell body having an opening at side. The driving unit is fixed in the main shell body, and the side cover plate is buckled at the opening and is detachably connected with the main shell body.

The present disclosure further provides smart net light strings, including strip-shaped connection pieces and the smart curtain light strings. The smart curtain light strings include the plurality of the LED lights. Each of the strip-shaped connection pieces is transversely and detachably connected with any two adjacent LED lights, and the strip-shaped connection pieces are disposed at intervals from top to bottom.

The present disclosure provides the LED light, the smart light strings, the smart curtain light strings, and the smart net light strings, and beneficial effects of the present disclosure are as following.

The LED light includes the conductive structure connected with the power supply, the plurality of the LED light beads, and the plurality of transparent light shells having transparent features. The plurality of the LED light beads are electrically connected with the conductive structure and disposed at intervals along the length direction of the conductive structure, however, each of the transparent light shells is corresponding to the respective LED light bead and wraps the respective LED light bead. Each of the transparent light shells includes the through holes for the conductive structure to penetrate through. The respective LED light bead and the respective wire connecting position between the respective LED light bead and the conductive structure are sealed by each of the transparent lamp shells, compared with direct use of the waterproof glue tape or sealants, a sealing effect is better, the service life is prolonged, and an appearance is more attractive.

BRIEF DESCRIPTION OF DRAWINGS

In order to more clearly illustrate technical solutions in embodiments of the present disclosure, following is a brief description of drawings required in the description of the embodiments or prior art, obviously, the drawings in the following description are only some embodiments of the present disclosure, and that other drawings may be obtained on the basis of these drawings for those who skilled in this art, without any creative labor.

In the drawings.

Figure 1:
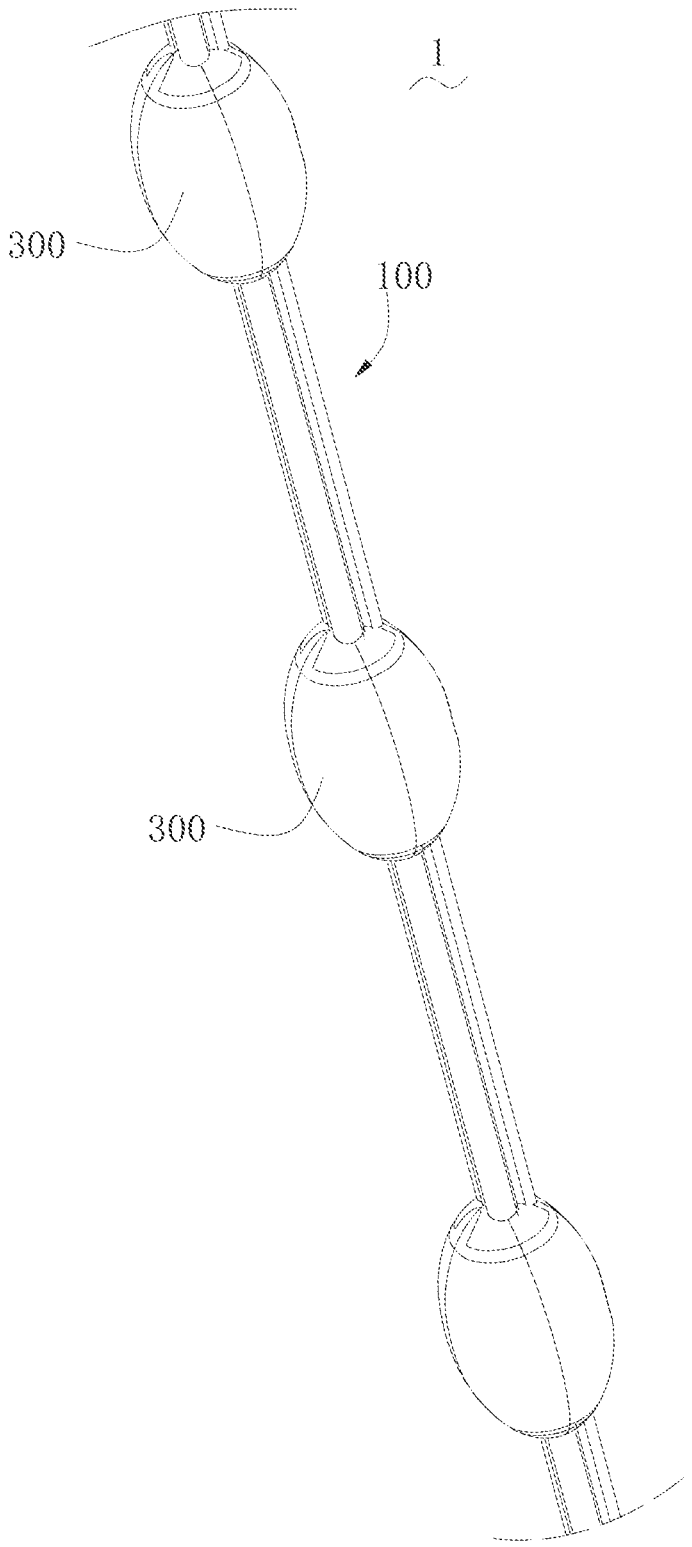
FIG. 1 is a partial three-dimensional schematic diagram of an LED light according to one embodiment of the present disclosure.

| | | | |
|---|---|---|---|
| LED light | 1 | Conductive structure | 100 |
| LED light bead | 200 | Transparent light shell | 300 |
| Through hole | 301 | Accommodation cavity | 302 |
| Glue injection hole | 303 | Glue port | 304 |
| Driving unit | 400 | Driving board | 410 |
| Driving shell | 420 | Connection port | 401 |
| Shell accommodation cavity | 402 | Bottom shell | 421 |
| Cover plate | 422 | Connection clamping block | 430 |
| Fixing connection hole | 4301 | Clamping groove | 4302 |
| Male connector | 500 | Female connector | 600 |
| Conductive wire | 700 | Clamping block | 440 |
| Clamping hole | 4401 | Clamping port | 403 |
| Clamping connection groove | 4402 | Half-shell | 310 |
| Smart light strings | 2 | Smart curtain light strings | 3 |
| Top shell | 10 | Butt-joint hole | 1001 |
| Counterbalance component | 20 | Wiring structure | 30 |
| First connection piece | 31 | Second connection piece | 32 |
| Butt component | 3101 | Snap ring component | 3102 |
| Locking component | 3103 | Nut | 3104 |
| Annular tube | 3201 | Fixing structure | 40 |
| U-shaped groove | 4001 | Groove-shaped piece | 41 |
| Pin | 42 | Fixing board | 43 |
| Clamping groove | 1002 | First side plate | 4101 |
| Second side plate | 4102 | Movable plate | 4104 |
| Bolt | 4105 | Side cover plate | 11 |
| Main shell body | 12 | Smart net light strings | 4 |
| Strip-shaped connection piece | 50 | Transparent clamping protrusion | 320 |
| Neck | 321 | Clamping hole | 5001 |

DETAILED DESCRIPTION

In order to make objects, technical solutions and advantages of the present disclosure more clear, the present disclosure is described in further detail below in conjunction with the accompanying drawings and embodiments. It should be understood that the specific embodiments described herein are for illustrative purposes only and are not intended to limit the present disclosure.

It should be noted that when an element is referred to as being "fixed" or "disposed on" another element, it may be directly on the other element or it may be indirectly fixed or disposed on another element through a third component. When an element is referred to as being "connected to" another element, it may be directly connected to another element or it may be indirectly connected to another element through a third component.

It should be understood that, terms "length", "width", "upper", "lower", "front", "left", "right", "vertical", "horizontal", "top", "bottom", "inner", "outer", etc., are based on an orientation or positional relationship shown in the drawings, but are merely intended to facilitate the description of the present disclosure and the simplified description, rather than to indicate or imply that the indicated device or element must have a particular orientation, constructed and operative in a particular orientation, and therefore not to be construed as a limitation of the present disclosure.

In addition, terms "first" and "second" are used for descriptive purposes only and are not to be construed as indicating or implying relative importance or implicitly indicating a number of technical features indicated. Thus, a feature defining "first" or "second" may explicitly or implicitly include one or more of the features. In the description of the present disclosure, the meaning of "a plurality" is two or more unless specifically defined otherwise.

Embodiment 1

Figure 2:
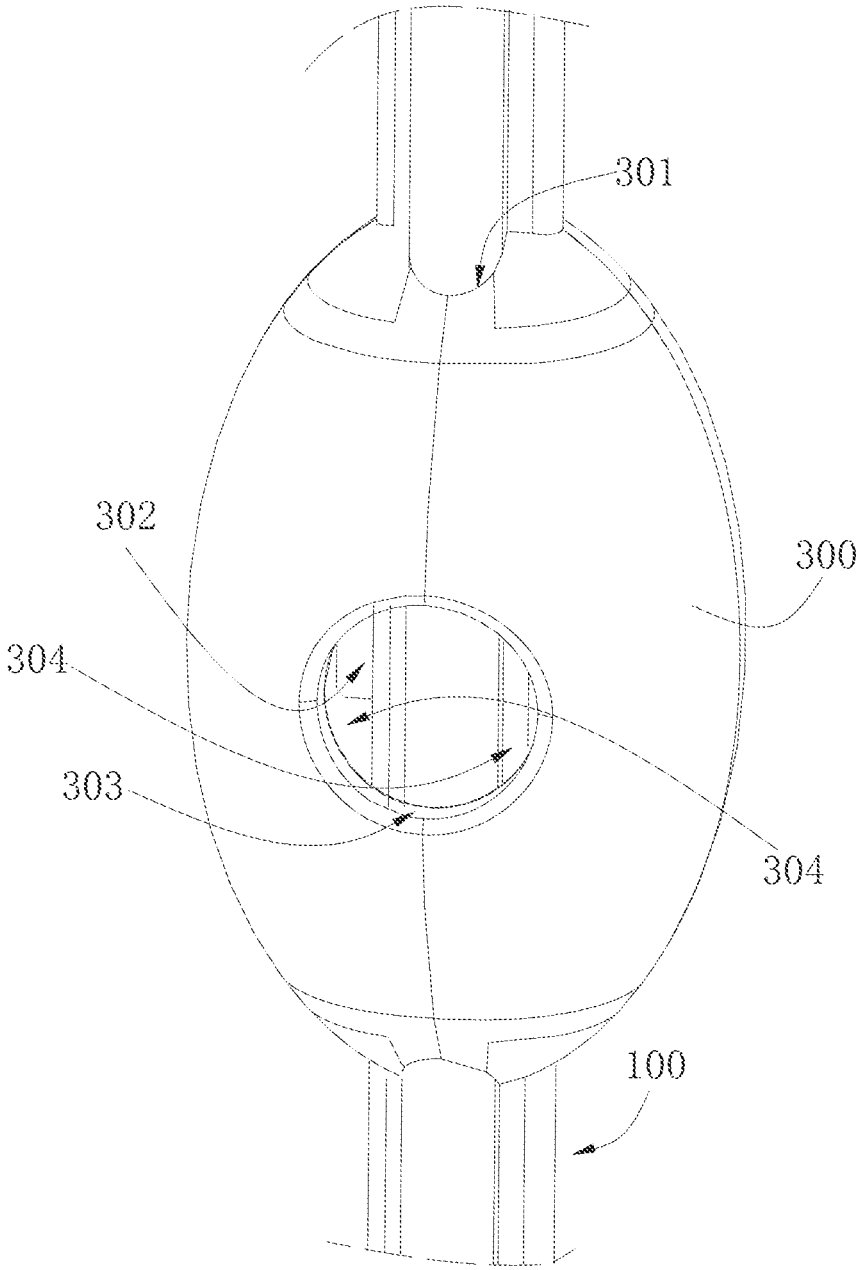
FIG. 2 is another partial three-dimensional schematic diagram of the LED light according to one embodiment of the present disclosure.
Figure 3:
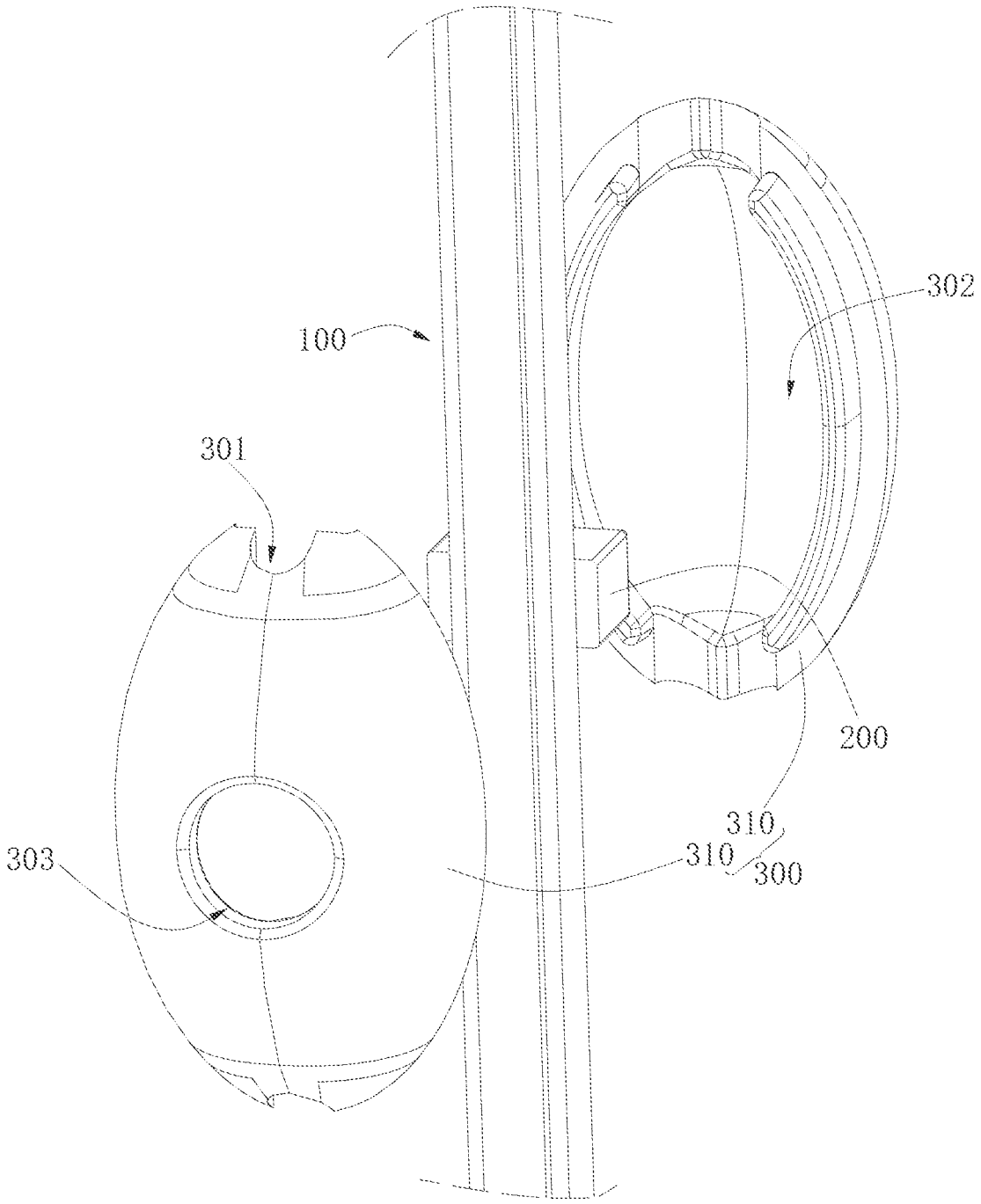
FIG. 3 is a partial exploded three-dimensional schematic diagram of the LED light according to one embodiment of the present disclosure.

As shown in FIGS. 1-3, the present disclosure provides an LED light 1, including a conductive structure 100 connected with a power supply and a plurality of LED light beads 200. The plurality of the LED light beads 200 are electrically connected with the conductive structure 100 and disposed at intervals along a length direction of the conductive structure 100. The LED light 1 further includes a plurality of transparent light shells 300, each of the transparent light shells 300 wraps a respective LED light bead 200. The conductive structure 100 penetrates through through holes 301 of each of the transparent light shells 300 to extend to outside, and each of the transparent light shells 300 seals the respective LED light bead 200 and a respective wire connecting position inside.

In one embodiment, the LED light 1 includes the conductive structure 100 connected with the power supply, the plurality of the LED light beads 200, and the plurality of transparent light shells 300 having transparent features. The plurality of the LED light beads 200 are electrically connected with the conductive structure 100 and disposed at intervals along the length direction of the conductive structure 100, however, each of the transparent light shells 300 is corresponding to the respective LED light bead 200 and wraps the respective LED light bead 200. Each of the transparent light shells 300 includes the through holes 301 for the conductive structure 100 to penetrate through. The respective LED light bead 200 and the respective wire connecting position between the respective LED light bead 200 and the conductive structure 100 are sealed by each of the transparent lamp shells 300, compared with direct use of the waterproof glue tape or sealants, a sealing effect is better, the service life is prolonged, and an appearance is more attractive.

In one embodiment, the conductive structure 100 includes three conductive wires, respectively a neutral wire, a live wire, and a grounding wire. The three conductive lines are fixed together and extend to a same direction. Each of the LED light beads 200 is electrically connected with the three conductive wires.

As shown in FIGS. 2-3, optionally, each of the transparent light shells 300 includes a respective accommodation cavity 302, the respective LED light bead 200 is disposed inside the respective accommodation cavity 302, and a gap is reserved between a cavity wall of the respective accommodation cavity 302 and the respective light bead 200 of each of the transparent light shells 300. Thus, on one hand, position interference between each of the transparent light shells 300 with the respective light bead 200 is avoided, and on an other hand, preparation for injecting liquid glue is done.

As shown in FIGS. 2-3, a respective glue injection hole 303 is formed on each of the transparent light shells 300. A transparent liquid glue is injected into each of the transparent light shells 300 from the respective glue injection hole 303, the transparent liquid glue is filled with the respective accommodation cavity 302 of each of the transparent light shells 300, and the transparent liquid glue is subjected to normal temperature standing or heating for curing to form a solid sealing body. Thus, waterproof performance of the LED lamp beads 200 and connection positions of the LED lamp beads 200 and the conductive structure 100 is achieved, the service life of the LED light 1 is prolonged, a better waterproof effect of the LED light 1 is achieved, a waterproof grade of the LED light 1 reaches IP65, and the LED lamp bead 200 can be applied to an outdoor lawn or a park and other occasions, which environment adaptability is improved.

As shown in FIGS. 2-3, optionally, the respective glue injection hole 303 on each of the transparent light shells 300 is disposed opposite to the respective LED light bead 200. Thus, the transparent light shells are ensured to have better light emitting effect.

As shown in FIGS. 2-3, optionally, each of the transparent light shells 300 is tightly connected with the conductive structure 100. Thus, on one hand, the liquid glue is effectively prevented from leaking out, and on an other hand, an installation position is fixed after installation.

As shown in FIG. 2, optionally, when the liquid glue is injected into the perspective glue injection hole 303, the conductive structure 100 divides an hole opening of the perspective glue injection hole 303 into two pairs of glue ports 304, and one of the two pairs of the glue ports 304 is opposite to a glue injection port of a glue injection device. When injecting the liquid glue into the perspective glue injection hole 303, it is necessary to keep the injection at an angle. Thus, a problem that bubbles are generated in the liquid glue due to simultaneous glue injection of the two pairs of the glue ports 304 is avoided, the liquid glue is not easy to discharge, and light uniformity is influenced.

Optionally, a surface of an inner wall of the respective accommodating cavity 302 of each of the transparent light shells 300 is a diffuse reflection surface. In this way, light rays can be emitted from the transparent light shells 300 as a whole by 360 degrees, and lighting and viewing effects are improved.

Optionally, the inner wall of the respective accommodation cavity 302 of each of the transparent light shells 300 is subjected to sanding treatment or sand blasting treatment, so that an uneven diffuse reflection surface is formed on the surface of the inner wall of the respective accommodation cavity 302. In one embodiment, the sand blasting treatment also blurs the transparent light shells 300, when the LED light beads 200 do not emit light, components inside the transparent light shells 300 are not visible from outside, and the ornamental value is better enhanced.

Optionally, the inner wall of the perspective accommodation cavity 302 of each of the transparent light shells 300 is coated with a transparent diffuse reflective coating (not shown in the drawings). In on embodiment, the diffuse reflective coating can be coated with a highly transparent optical coating, and has functions of water resistance, acid resistance, alkali resistance, salt resistance, high temperature resistance, low temperature resistance and the like, and can effectively reduce loss of light.

Optionally, each of transparent light shells 300 is a circular or elliptical shape. In one embodiment, a shape of each of the transparent light shells 300 is elliptical, and the curved transparent light shells may form a rich visual performance effect. Certainly, any geometric shape may also be used, not limiting herein.

Optionally, each of the transparent light shells 300 is made of acrylic materials.

As shown in FIG. 3, furthermore, each of the transparent light shells 300 includes two half-shells 310, the two half-shells 310 are fastened together and jointly wrap the respective LED light bead 200. Thus, convenience of assembly is improved. In one embodiment, the perspective glue injection hole 303 is disposed on a perspective half-shell 310.

Embodiment 2

As shown in FIGS. 1-4, the present disclosure provides smart light strings 2, including a driving unit 400 and the LED light 1 according to embodiment one. The driving unit 400 includes a driving board 410 and a driving shell 420. The driving board 410 is fixed in the driving shell 420, a connection port 401 is disposed on the driving shell 420, and an end of the conductive structure 100 penetrates through the connection port 401 and is connected to the driving board 410. A plurality of IC points are disposed on the driving board 410, and each of the IC points is connected with a respective LED light bead 200 to achieve a single-point control effect.

Figure 4:
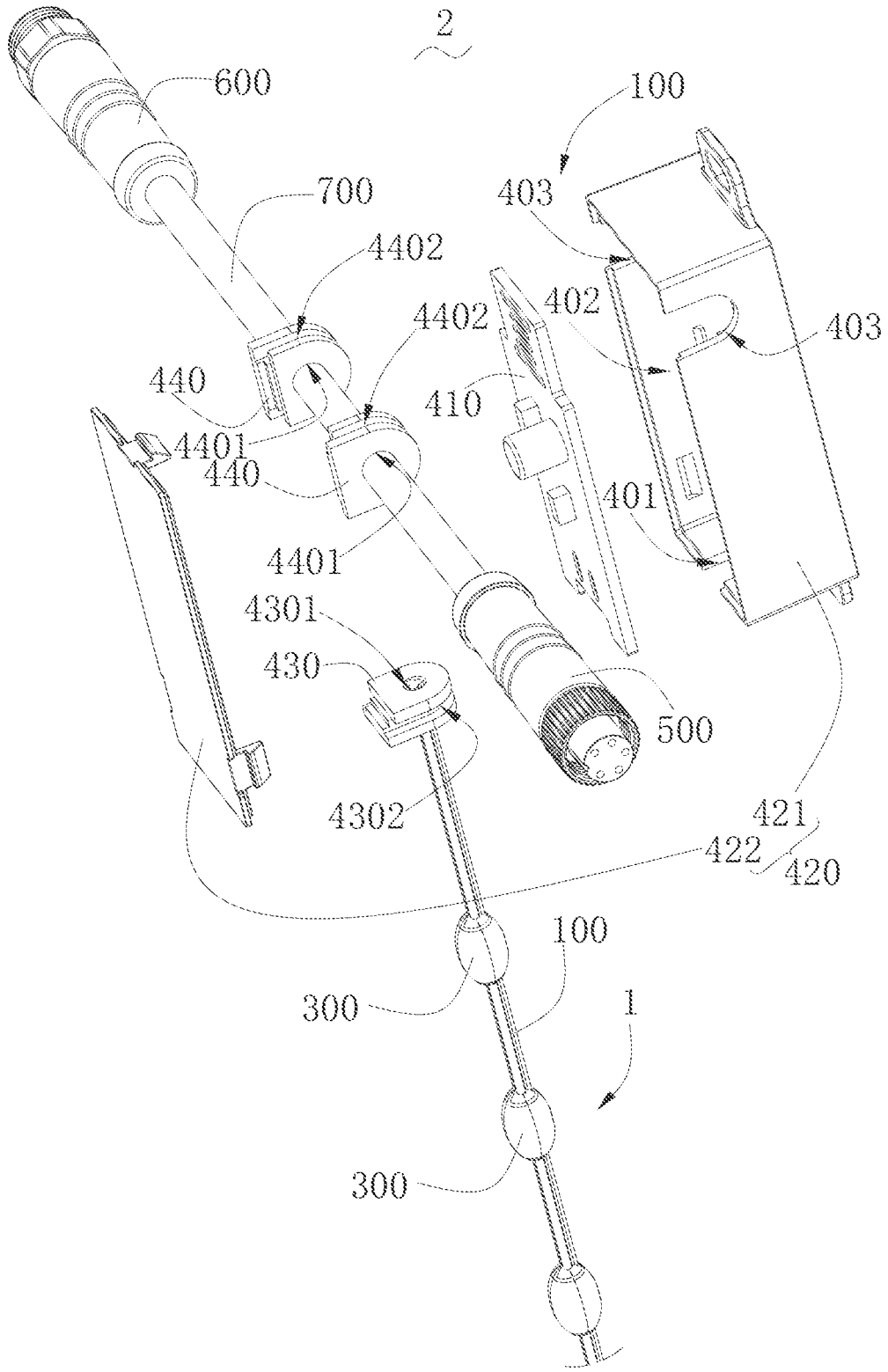
FIG. 4 is a partial exploded three-dimensional schematic diagram of smart light strings according to one embodiment of the present disclosure.

As shown in FIG. 4, optionally, the driving shell 420 includes a bottom shell 421 having a shell accommodation cavity 402 and a cover board 422 detachably connected with the bottom shell 421. The driving board 410 is fixed to the shell accommodation cavity 402, and the connection port 401 is disposed on the bottom shell 421.

In one embodiment, the bottom shell 421 is connected with the cover board 422 through a buckle structure 430, so that quick assembly and disassembly are facilitated, and subsequent repair, maintenance or replacement parts are further facilitated.

As shown in FIG. 4, optionally, the driving unit 400 further includes a connection clamping block 430. A fixing connection hole 4301, communicated up and down, is disposed on the connection clamping block 430. An end of the conductive structure 100 penetrates through the fixing connection hole 4301 and and is tightly connected to the fixing connection hole 4301. And the connection clamping block 430 is inserted in the connection port 401 of the bottom shell 421.

In one embodiment, the end of the conductive structure 100 is electrically connected with the driving board 410. Due to environmental factors, a weight of the conductive structure 100 itself, and weights of the plurality of the LED light beads 200 and the transparent light shells 300, electrical connection of the conductive structure 100 and the driving board 410 is not stable. The end of the conductive structure 100 is fixed through the connection clamping block 430, and the connection clamping block 430 is inserted into the connection port 401 of the bottom shell 421, so that the end of the conductive structure 100 can be indirectly fixed, and reliability and stability of the electrical connection are improved.

As shown in FIG. 4, optionally, a clamping groove 4302 is disposed on a peripheral side of the connection clamping block 430, and an edge of the connecting port 401 of the bottom shell 421 is inserted into the clamping groove 4302 and matched with the clamping groove 4302. In this way, the connection clamping block 430 is limited, so that the connection clamping block 430 is prevented from moving, so that stability of the connection clamping block 430 is better improved, connection reliability between the conductive structure 100 and the driving board 410 is better achieved, and the service life of the LED light 1 is prolonged.

As shown in FIG. 4, furthermore, the smart light strings further include at least one male connector 500 and female connector 600. The male connector 500 and the female connector 600 are electrically connected with the driving board 410 through a respective conductive wire 700. In this way, the male connector 500 and the female connector 600 are extended and butted, namely the plurality of the LED lights 1 are disposed, the male connector 500 between any two adjacent LED lights 1 is in butt joint with the respective female connector 600, and a curtain screen effect and extensible characteristics of the LED lights 1 are achieved.

As shown in FIG. 4, optionally, the driving unit 400 further includes two wire clamping blocks 440, a respective wire clamping hole 4401 is disposed on each of the wire clamping blocks 440, an end of the respective conductive wire 700 penetrates through the wire clamping hole 4401 and is fixed to the clamping wire hole 4401. Two clamping ports 403 are formed on the bottom shell 421, and each of the wire clamping blocks 440 is clamped on a perspective clamping port 403. It can be understood that there are same effect as the connection clamping block 430 is disposed on the end of the conductive structure 100, which may not be repeated here.

As shown in FIG. 4, optionally, a clamping connection groove 4402 is disposed on a peripheral side of each of the wire clamping blocks 440, and an edge of each of the clamping ports of the bottom shell 421 is inserted into clamping connection groove 4402 and matched with the clamping connection groove 4402. An effect of the clamping connection groove 4402 is same as an effect of the clamping groove 4302 on the connection clamping block 430, which may not be repeated here.

Embodiment 3

Figure 5:
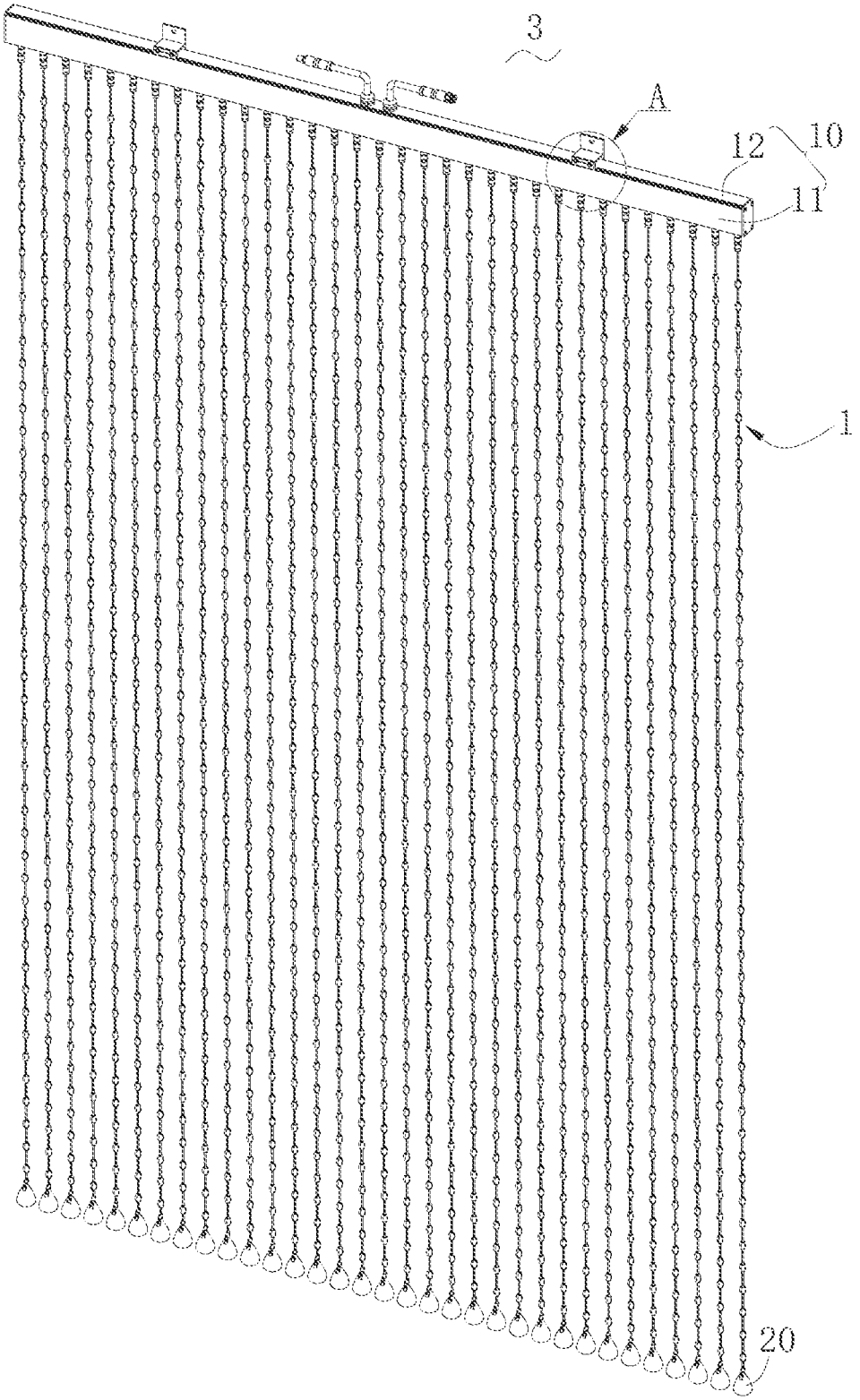
FIG. 5 is a three-dimensional schematic diagram of smart curtain light strings according to one embodiment of the present disclosure.
Figure 6:
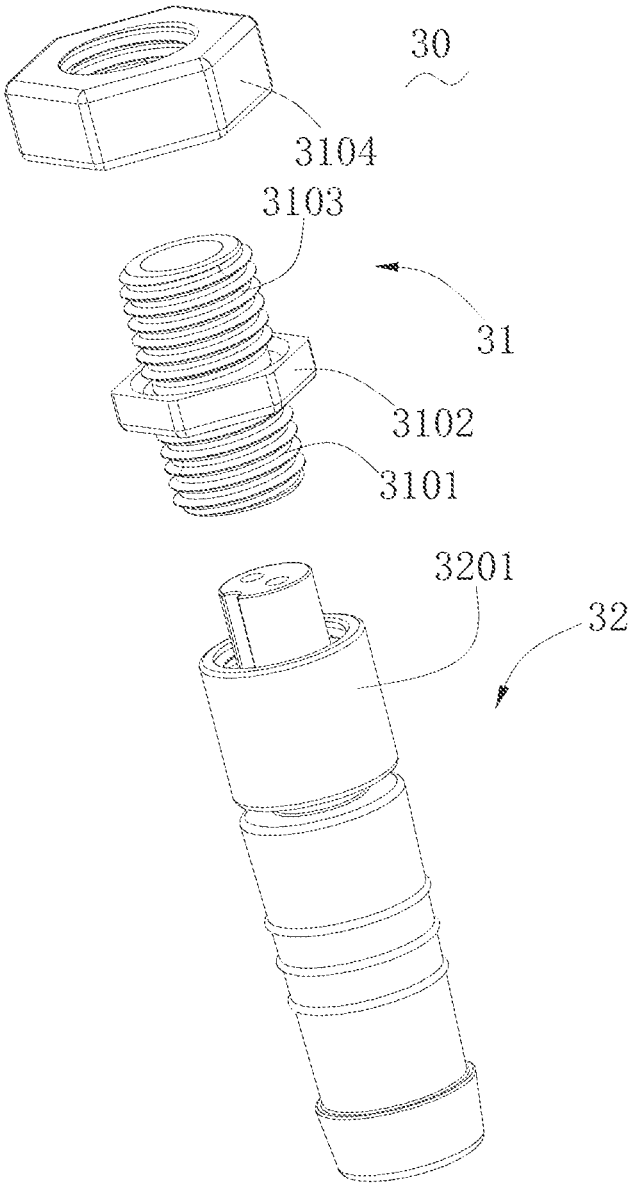
FIG. 6 is a exploded three-dimensional schematic diagram of a wiring structure according to one embodiment of the present disclosure.
Figure 7:
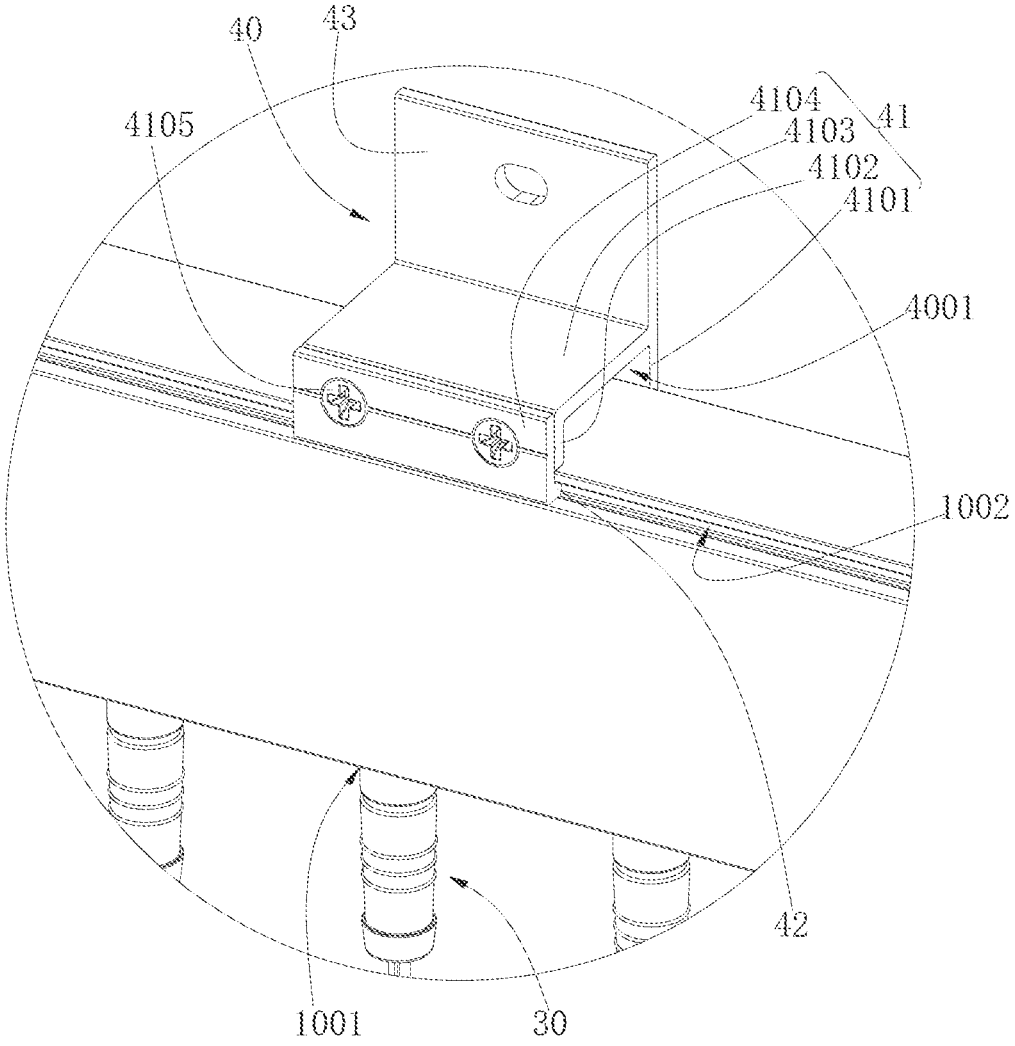
FIG. 7 is an enlarged schematic diagram of portion A shown in FIG. 5.

As shown in FIGS. 5-7, the present disclosure provides smart curtain light strings 3, including a top shell 10, a driving unit (not shown in the drawings), and a plurality of the LED lights 1 according to embodiment one. The driving unit is fixed to the top shell 10 and is electrically connected with an external power source. A plurality of butt-joint holes 1001 disposed at intervals are formed on a bottom of the top shell 10. An end of each of the plurality of the LED lights 1 is driven and connected with the driving unit through a respective butt-joint hole 1001. Each of the plurality of the LED lights 1 is vertically disposed below the top shell 10.

In one embodiment, refer to FIGS. 1-3 according to embodiment one, a plurality of the LED lights are disposed at equal intervals so as to integrally form a curtain-type array. Each of LED lights 1 includes the conductive structure 100 and the plurality of the LED light beads 200 and the transparent light shells 300. The LED light beads 200 are electrically connected to the conductive structure 100 and disposed at equal intervals. Each of the transparent light shells 300 wraps the perspective LED light bead 200 to form the smart curtain light strings, so that a decorative area is increased, and expandability of the smart curtain light strings is improved.

As shown in FIGS. 1 and 5, optionally, the smart curtain light strings further include a plurality of counterbalance components 20, each of the counterbalance components 20 is insulated and connected to a bottom of a perspective LED light 1. Specifically, the counterbalance components 20 are insulated and connected to one end of the conductive structure 100, and an another end of the conductive structure 100 is connected to the power source. In this way, the metal counterbalance components 20 are selected to ensure an overall vertical degree of the LED light strings.

In one embodiment, through using the counterbalance component 20, the conductive structure 100 having the LED light beads 200 forms a pendant shape, so that an overall installation of the smart curtain light strings 3 is facilitated, and the an overall decoration effect of the smart curtain light strings 3 is improved.

As shown in FIGS. 5-7, furthermore, the smart curtain light strings 3 further include a plurality of wiring structures 30. Each of the wiring structures 30 includes a respective first connection piece 31 and a respective second connection piece 32. The respective first connection piece 31 is fixedly connected with an end of a respective LED light 1, the respective second connection piece 32 is fixed to the respective butt-joint hole 1001 and is connected with the driving unit. The respective first connection piece 31 is detachably connected with the respective second connection piece 32, so that the plurality of the LED lights 1 establish a driving connection with the driving unit, which prevents connection instability of each of the LED lights 1 and the driving unit and prolongs an overall service life of the smart curtain light strings 3.

In one embodiment, the respective first connection piece 31 includes a butt component 3101, a snap ring component 3102, and a locking component 3103. The snap ring component 3102 is disposed between the butt component 3101 and the locking component 3103. Specifically, external threads are disposed on both the butt component 3101 and the locking component 3103. A contact pin connected to the driving unit is disposed inside the butt component 3101. The locking component 3103 is inserted into the butt-joint hole 1001, the snap ring component 3102 abuts against a bottom of the top shell 10, the locking component 3103 extends into an end of the top shell 10 and is locked by a nut 3104, and then the respective first connection piece 31 is fixed on the top shell 10.

In one embodiment, an annular tube 3201 is disposed on an outer side of a plug-in end in the respective second connection piece 32. Internal threads are disposed on the annular tube 3201. When the butt component 3101 of the respective first connection piece 31 is in butt joint with the respective second connection piece 3, the annular tube 3201 is in threaded locking fixation with the butt component 3101, and the contact pin is inserted and matched with an insertion hole of the respective second connection piece 32 to realize communication of a driving circuit. The respective first connection piece 31 is in butt joint with the respective second connection piece 32 to enable each of the LED lights 1 to be in driving connection with the driving unit.

As shown in FIGS. 5-7, furthermore, the smart curtain light strings 3 include at least two fixing structures 40. Each of the fixing structures 40 includes a groove-shaped piece 41 having a U-shaped groove 4001, pins 42 protruding from two inner side walls of the U-shaped groove 4001, and a fixing board 43 extending from a back surface of the groove-shaped piece 41 in a direction distal from the U-shaped groove 4001. Clamping grooves 1002 are formed at two sides of a top in the top shell 10, and each of the clamping pins 42 is inserted into a respective clamping groove 2002. The fixing board 43 can be fixed on any object, so that a whole fixing of the smart curtain light strings 3 is realized, and a better decoration effect is achieved.

As shown in FIGS. 5-7, the groove-shaped piece 41 includes a first side plate 4101, a second side plate 4102, a connection plate 4103, and a movable plate 4104. The first side plate 4101 and the second side plate 4102 are respectively connected to opposite sides of the connection plate 4103 and jointly form the U-shaped groove 4001 with the connection plate 4103. The first side plate 4101 is higher than the second side plate 4102. A respective pin 42 is disposed on a plate surface, facing the second side plate 4102, of the first side plate 4101. An another pin 42 is disposed on a plate surface of the movable plate 4104. The movable plate 4104 is detachably connected with the second side plate 4102, and the respective pin 42 is opposite to the another perspective pin 42. Thus, on one hand, assembly and disassembly are convenient, and on an other hand, use is more flexible, and adjustability is relatively greater.

In one embodiment, the movable plate 4104 is fixedly connected with the second side plate 4102 through at least one bolt 4105. When the top shell 10 is relatively wide, a gasket can be selected between the movable plate 4104 and the second side plate 4102, so that the pins are clamped with the clamping groove 1002 of the top shell 10.

As shown in FIGS. 5-7, optionally, the top shell 10 includes a side cover plate 11 and a main shell body 12 having an opening (not shown in the drawings) at side. The driving unit is fixed in the main shell body 12, and the side cover plate 11 is buckled at the opening and is detachably connected with the main shell body 12. Thus, on one hand, convenience of assembly and disassembly is improved, use of screws is reduced, and assembly and disassembly efficiency is improved, on an other hand, components inside the top shell 10 can be repaired, maintained and replaced conveniently.

In one embodiment, the side cover plate 11 is achieved to be detachably connected with the main shell body 12 through the buckle structure.

Embodiment 4

Figure 8:
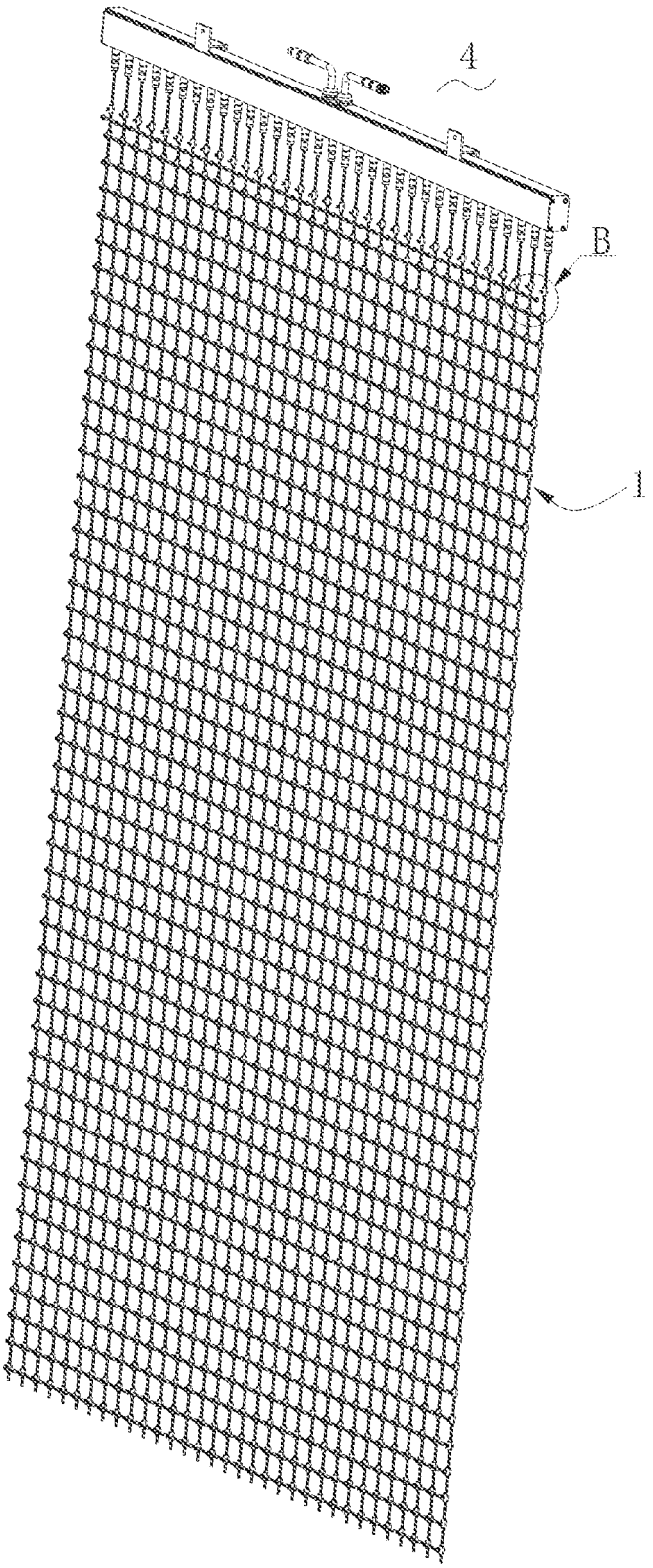
FIG. 8 is a partial exploded three-dimensional schematic diagram of smart net light strings according to one embodiment of the present disclosure.
Figure 9:
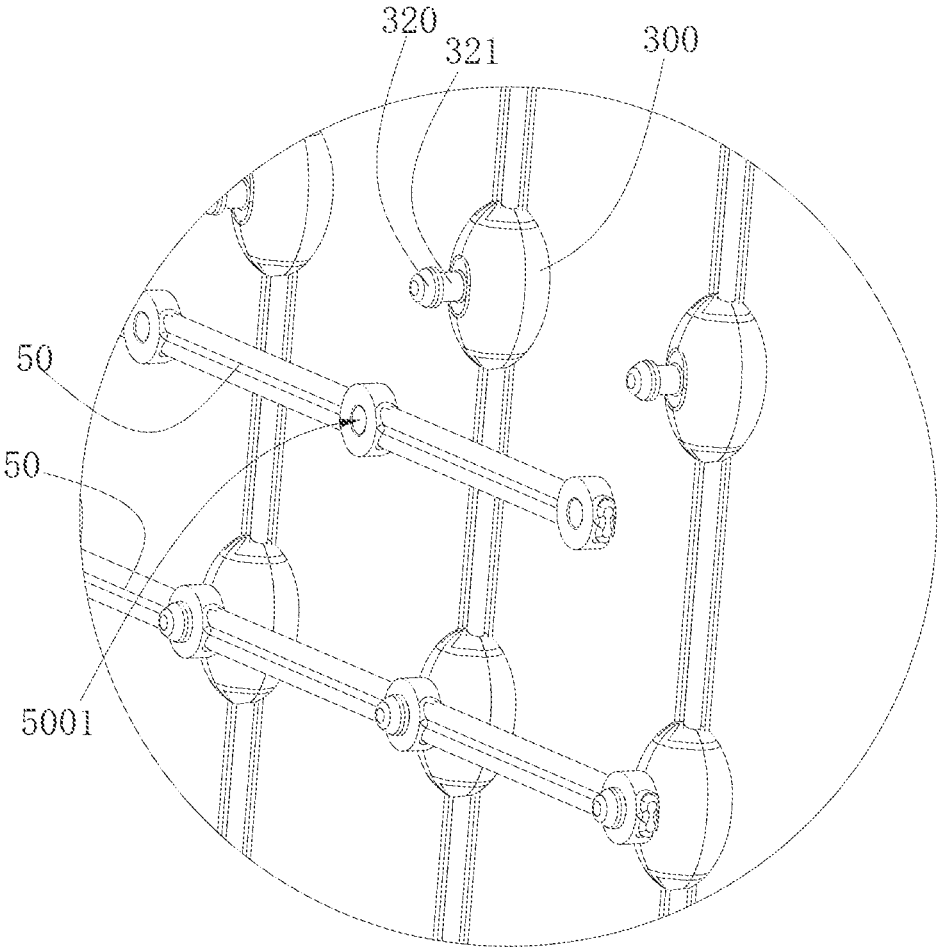
FIG. 9 is an enlarged schematic diagram of portion B shown in FIG. 8.

As shown in FIGS. 8-9 and FIG. 5 according to embodiment three, the present disclosure provides smart net light strings 4, including strip-shaped connection pieces 50 and the smart curtain light strings 3 according to embodiment three. The smart curtain light strings 3 include the plurality of the LED lights 1. Each of the strip-shaped connection pieces 50 is transversely and detachably connected with any two adjacent LED lights 1, and the strip-shaped connection pieces are disposed at intervals from top to bottom.

In one embodiment, by setting the smart net light strings 4 into a net-like layout, positioning stability of using the LED light beads is improved, displacement due to external forces such as outdoor wind is prevented, thereby avoid affecting normal decorative use of the LED light beads. The net-like layout enhances decorative beautification of lawns, parks or building surfaces, which greatly enhances an ornamental effect and has good waterproof effect.

As shown in FIG. 9, furthermore, a perspective transparent clamping protrusion 320 is disposed on an outer wall of each of transparent light shells 300. The perspective transparent clamping protrusion 320 includes a neck 321. A perspective clamping hole 5001 is disposed on each of the strip-shaped connection pieces 50, a number of the clamping holes 5001 is equal to a number of the LED lights 1, and the perspective clamping hole 5001 is clamped on the neck 321 of the perspective transparent clamping protrusion 320. Specifically, the strip-shaped connection pieces 50 are transparent glue pieces, and are elastically stretchable.

The foregoing is only preferred embodiments of the present disclosure, and is not intended to limit the present disclosure. Any modifications, equivalent replacements and improvements made within spirits and principles of the present disclosure shall be included in scopes of protection of the present disclosure.

What is claimed is:

1. An LED light, comprising:

a conductive structure;

a plurality of LED light beads; and a plurality of transparent light shells;

wherein the conductive structure is connected with a power supply; the plurality of the LED light beads are electrically connected with the conductive structure and disposed at intervals along a length direction of the conductive structure; each of the transparent light shells wraps a respective LED light bead; the conductive structure penetrates through holes of each of the transparent light shells to extend to outside; and each of the transparent light shells seals the respective LED light bead and a respective wire connecting position inside;

wherein each of the transparent light shells comprises a respective accommodation cavity; the respective LED light bead is disposed inside the respective accommodation cavity; and a gap is reserved between a cavity wall of the respective accommodation cavity and the respective light bead of each of the transparent light shells;

wherein a respective glue injection hole is formed on each of the transparent light shells; a transparent liquid glue is injected into each of the transparent light shells from the respective glue injection hole, the transparent liquid glue is filled with the respective accommodation cavity of each of the transparent light shells, and the transparent liquid glue is subjected to normal temperature standing or heating for curing to form a solid sealing body.

2. The LED light according to claim 1, wherein the respective glue injection hole on each of the transparent light shells is disposed opposite to the respective LED light bead.

3. The LED light according to claim 1, wherein each of the transparent light shells comprises two half-shells, the two half-shells are fastened together and jointly wrap the respective LED light bead.

4. Smart light strings, comprising:

a driving unit; and an LED light;

wherein the LED light comprises a conductive structure, a plurality of LED light beads, and a plurality of transparent light shells;

wherein the conductive structure is connected with a power supply; the plurality of the LED light beads are electrically connected with the conductive structure and disposed at intervals along a length direction of the conductive structure; each of the transparent light shells wraps a respective LED light bead; the conductive structure penetrates through holes of each of the transparent light shells to extend to outside; and each of the transparent light shells seals the respective LED light bead and a respective wire connecting position inside;

wherein the driving unit comprises a driving board and a driving shell; the driving board is fixed in the driving shell, a connection port is disposed on the driving shell, and an end of the LED light penetrates through the connection port and is connected to the driving board.

5. The smart light strings according to claim 4, wherein the driving shell comprises a bottom shell having a shell accommodation cavity and a cover board detachably connected with the bottom shell; the driving board is fixed to the shell accommodation cavity, and the connection port is disposed on the bottom shell.

6. The smart light strings according to claim 5, wherein the driving unit further comprises a connection clamping block; a fixing connection hole, communicated up and down, is disposed on the connection clamping block; an end of the conductive structure penetrates through the fixing connection hole and is tightly connected to the fixing connection hole; and the connection clamping block is inserted in the connection port of the bottom shell.

7. Smart curtain light strings, comprising:

a top shell;

a driving unit; and a plurality of LED lights wherein the plurality of the LED lights comprise a conductive structure, a plurality of LED light beads, and a plurality of transparent light shells;

wherein the conductive structure is connected with a power supply; the plurality of the LED light beads are electrically connected with the conductive structure and disposed at intervals along a length direction of the conductive structure; each of the transparent light shells wraps a respective LED light bead; the conductive structure penetrates through holes of each of the transparent light shells to extend to outside; and each of the transparent light shells seals the respective LED light bead and a respective wire connecting position inside;

wherein the driving unit is fixed to the top shell and electrically connected with an external power source; a plurality of butt-joint holes disposed at intervals are formed on a bottom of the top shell; an end of each of the plurality of the LED lights is driven and connected with the driving unit through a respective butt-joint hole; each of the plurality of the LED lights is vertically disposed below the top shell.

8. The smart curtain light strings according to claim 7, wherein the smart curtain light strings further comprise a plurality of wiring structures; each of the wiring structures comprises a respective first connection piece and a respective second connection piece; the respective first connection piece is fixedly connected with an end of a respective LED light, the respective second connection piece is fixed to the respective butt-joint hole and is connected with the driving unit; the respective first connection piece is detachably connected with the respective second connection piece, so that the plurality of the LED lights establish a driving connection with the driving unit.

9. The smart curtain light strings according to claim 7, wherein the smart curtain light strings comprise at least two fixing structures; each of the fixing structures comprises a groove-shaped piece having a U-shaped groove, pins protruding from two inner side walls of the U-shaped groove, and a fixing board extending from a back surface of the groove-shaped piece in a direction distal from the U-shaped groove; clamping grooves are formed at two sides of a top in the top shell, and each of the clamping pins is inserted into a respective clamping groove.

10. The smart curtain light strings according to claim 9, wherein the groove-shaped piece comprises a first side plate, a second side plate, a connection plate, and a movable plate; the first side plate and the second side plate are respectively connected to opposite sides of the connection plate and jointly form the U-shaped groove with the connection plate; the first side plate is higher than the second side plate; a respective pin is disposed on a plate surface, facing the second side plate, of the first side plate; an another respective pin is disposed on a plate surface of the movable plate; the movable plate is detachably connected with the second side plate, and the respective pin is opposite to the another perspective pin.

11. The smart curtain light strings according to claim 7, the top shell comprises a side cover plate and a main shell body having an opening at side; the driving unit is fixed in the main shell body, and the side cover plate is buckled at the opening and is detachably connected with the main shell body.

12. Smart net light strings, comprising:

strip-shaped connection pieces; and the smart curtain light strings according to claim 7;

wherein the smart curtain light strings comprise the plurality of the LED lights; each of the strip-shaped connection pieces is transversely and detachably connected with any two adjacent LED lights, and the strip-shaped connection pieces are disposed at intervals from top to bottom.

* * * * *